US009577330B2

(12) United States Patent
Piskun

(10) Patent No.: US 9,577,330 B2
(45) Date of Patent: Feb. 21, 2017

(54) MODIFIED VIVALDI ANTENNA WITH DIPOLE EXCITATION MODE

(71) Applicant: Google Inc., Mountain View, CA (US)

(72) Inventor: Vadim Piskun, San Jose, CA (US)

(73) Assignee: GOOGLE INC., Mountain View, CA (US)

( * ) Notice: Subject to any disclaimer, the term of this patent is extended or adjusted under 35 U.S.C. 154(b) by 92 days.

(21) Appl. No.: 14/585,434

(22) Filed: Dec. 30, 2014

(65) Prior Publication Data

US 2016/0190691 A1 Jun. 30, 2016

(51) Int. Cl.

| | |
|---|---|
| ***H01Q 21/00*** | (2006.01) |
| ***H01Q 5/30*** | (2015.01) |
| ***H01Q 5/50*** | (2015.01) |
| ***H01Q 1/38*** | (2006.01) |
| ***H01Q 13/10*** | (2006.01) |
| ***H01Q 5/357*** | (2015.01) |

(52) U.S. Cl.

CPC ..... *H01Q 5/30* (2015.01); *H01Q 1/38* (2013.01); *H01Q 5/357* (2015.01); *H01Q 5/50* (2015.01); *H01Q 13/10* (2013.01); *H01Q 13/106* (2013.01)

(58) Field of Classification Search

CPC ..... H01Q 13/10; H01Q 21/00

USPC ..... 343/767, 770

See application file for complete search history.

(56) References Cited

U.S. PATENT DOCUMENTS

| | | | | |
|---|---|---|---|---|
| 6,525,696 | B2 | 2/2003 | Powell et al. | |
| 6,842,154 | B1 | 1/2005 | Apostolos | |
| 6,900,770 | B2 | 5/2005 | Apostolos | |
| 7,088,300 | B2 | 8/2006 | Fisher | |
| 2005/0078043 | A1 | 4/2005 | Apostolos et al. | |
| 2013/0038495 | A1 | 2/2013 | Benzel et al. | |
| 2013/0285865 | A1* | 10/2013 | Lo Hine Tong ..... | H01Q 13/085 343/767 |

FOREIGN PATENT DOCUMENTS

| | | |
|---|---|---|
| EP | 1425822 A2 | 6/2004 |
| EP | 2575210 A1 | 4/2013 |

OTHER PUBLICATIONS

Notification of Transmittal of the International Search Report and the Written Opinion of the International Search Authority for PCT/US2015/067656, dated Apr. 21, 2016, 15 pages.

* cited by examiner

*Primary Examiner* — Hoang V Nguyen
(74) *Attorney, Agent, or Firm* — Morris & Kamlay LLP

(57) ABSTRACT

Systems and techniques are provided for a modified Vivaldi antenna with dipole excitation mode. An antenna may include a ground plane and a modified Vivaldi antenna. The modified Vivaldi antenna may include a straight arm with a first end and a second end, the first end being attached to the ground plane, a tapered section, and a balun placed partially between the straight arm and the tapered section. The modified Vivaldi antenna may be placed such that there is a gap between the tapered section and the ground plane. A feed element may be placed such that the feed element crosses the gap between the tapered section of the modified Vivaldi antenna and the ground plane.

20 Claims, 9 Drawing Sheets

MODIFIED VIVALDI ANTENNA WITH DIPOLE EXCITATION MODE

BACKGROUND

A multi-band antenna may include antenna elements that can operate on separate frequency bands. This may allow for a single antenna to be used in an electronic device that may need to be able to send and receive signals on distinct frequency bands. In order to operate on the separate frequency bands, the multi-band antenna may include a separate antenna element for each frequency band. This may result in a multi-band antenna having a larger footprint than a single band antenna, as each antenna element of the multi-band antenna may be arranged to not touch or overlap the other antenna elements except at a common feed point. Multi-band antennas used inside of electronic devices may end up with lower efficiency or narrower frequency bandwidths due to the lack of space for the separate antenna elements. Vivaldi antennas may have a small footprint, and may be used inside of such electronic devices. Vivaldi antennas may operate over a continuous bandwidth, and may therefore not be useful when a multi-band antenna is needed.

BRIEF SUMMARY

According to an embodiment of the disclosed subject matter, an antenna may include a ground plane and a modified Vivaldi antenna. The modified Vivaldi antenna may include a straight arm with a first end and a second end, the first end being attached to the ground plane, a tapered section, and a balun placed partially between the straight arm and the tapered section. The modified Vivaldi antenna may be placed such that there is a gap between the tapered section and the ground plane. A feed element may be placed such that the feed element crosses the gap between the tapered section of the modified Vivaldi antenna and the ground plane.

The ground plane may be perpendicular to the modified Vivaldi antenna. The gap may be between an edge of the ground plane and the modified Vivaldi antenna, or between an edge of the modified Vivaldi antenna and the ground plane. The modified Vivaldi antenna may include copper. The gap between the tapered section and the ground plane may be at most 0.1 mm. A trace may connect the feed element to a power source. A ground plane extension may be attached to the ground plane. The ground plane extension may attach to the ground plane diametrically opposite where the straight arm attaches to the ground plane.

The tapered section may taper away from the ground plane towards a bottom of the modified Vivaldi antenna. The balun may be a rectangular cut-out between the straight arm and the tapered section. The current in the feed element may induce a voltage in the gap. The gap may be a radiator for high frequency operation of the modified Vivaldi antenna in a tapered slot mode. The ground plane may be a radiator for low frequency operation of the modified Vivaldi antenna in a dipole mode. The ground plane may be a printed circuit board.

An antenna may include a modified Vivaldi antenna with a straight arm, a balun, and a tapered section, a wall, and a ground plane. The modified Vivaldi antenna may be placed on the wall such that the straight arm is connected to the ground plane and there is a gap between the tapered section and the ground plane.

A ground plane extension may be attached to the ground plane, the ground plane extension disposed on the wall opposite the modified Vivaldi antenna. The gap between the tapered section and the ground plane may be at most 0.1 mm. A feed element may be placed across the gap between the ground plane and the tapered section. The gap may be a radiator for high frequency operation of the modified Vivaldi antenna. The ground plane may be a radiator for low frequency operation of the modified Vivaldi antenna.

The modified Vivaldi antenna may operates on a first frequency band with the ground plane and straight arm, and may operate on a second frequency band with the gap between the tapered section and the ground plane. The first frequency band may be lower than the second frequency band.

According to an embodiment of the disclosed subject matter, a means for obtaining a modified Vivaldi antenna, a means for attaching a straight arm of the modified Vivaldi antenna to a ground plane, leaving a gap between a tapered section of the modified Vivaldi antenna and the ground plane, and a means for attaching a feed element across the gap are included.

Systems and techniques disclosed herein may allow for a modified Vivaldi antenna with dipole excitation mode. Additional features, advantages, and embodiments of the disclosed subject matter may be set forth or apparent from consideration of the following detailed description, drawings, and claims. Moreover, it is to be understood that both the foregoing summary and the following detailed description are examples and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
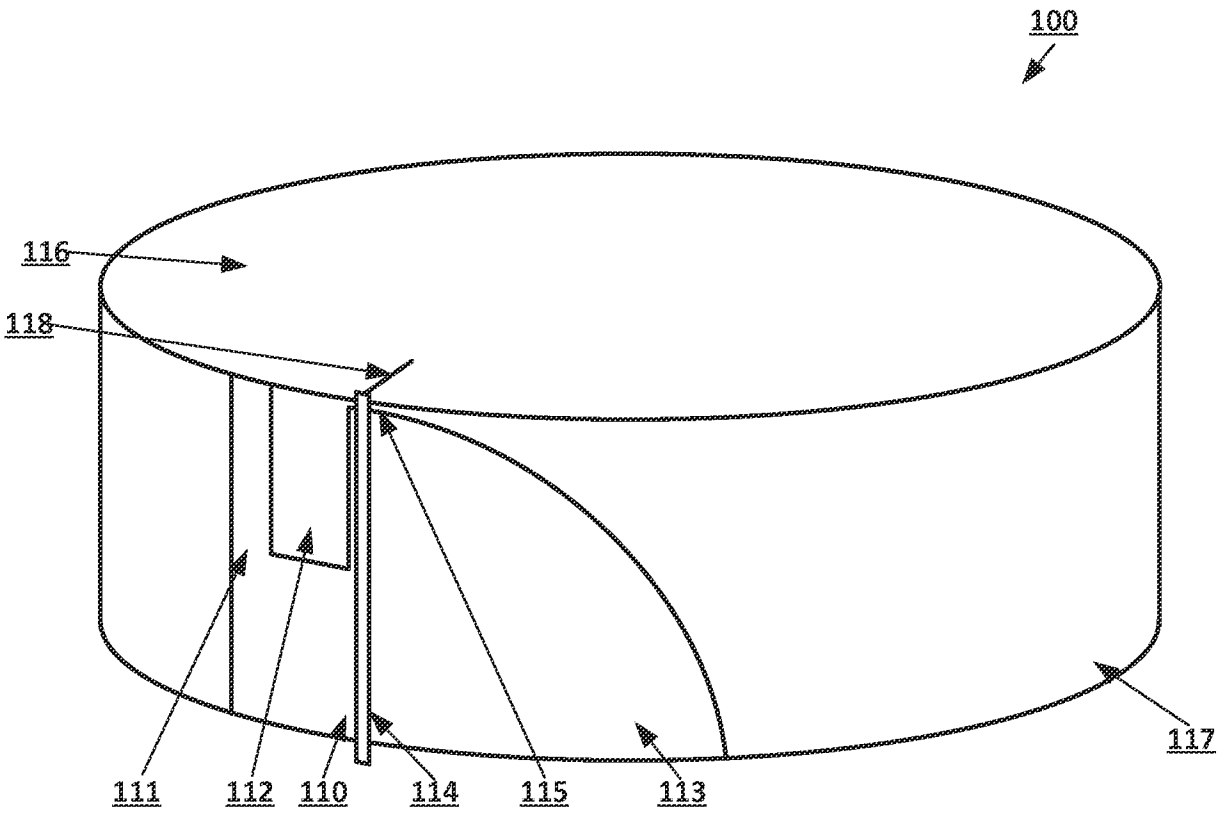
FIG. 1 shows an example perspective view of a modified Vivaldi antenna with a dipole excitation mode according to an implementation of the disclosed subject matter.

According to embodiments disclosed herein, a modified Vivaldi antenna with a dipole excitation mode may include antenna elements for separate frequency bands while not requiring additional surface area relative to an essentially equivalent conventional single-band Vivaldi antenna. A modified Vivaldi antenna may use a ground plane to send and receive signals at lower frequencies in a dipole mode, and gap between the body of the modified Vivaldi antenna and the ground plane to send and receive signals at higher frequencies. A modified Vivaldi antenna may include a straight arm, a balun, and a tapered section. The straight arm of the modified Vivaldi antenna may be connected to a ground plane. There may be a gap in between the tapered section and the ground plane. A feed element for the modified Vivaldi antenna may cross the gap between the tapered section and the ground plane. The feed element may be connected to a trace, which may connect to an amplifier used to feed a signal to the modified Vivaldi antenna. The ground plane may include a ground plane extension, which may be connected to a portion of the ground plane a suitable distance away from, or on the opposite side of the ground plane from, the connection between the ground plane and the straight arm. An insulator or dielectric material may be in between the feed and the modified Vivaldi antenna, and may also cross the gap between the tapered section and the ground plane. The modified Vivaldi antenna may be of any suitable size, and may be installed within electronic devices, such as, for example, sensors used in smart home environment.

The modified Vivaldi antenna may include the straight arm, the balun, and the tapered section. The straight arm and the tapered section may be formed from a single piece of any suitable material, or from material that has been joined in any suitable manner. For example, the straight arm and tapered section may be formed from PCB flex material. The balun may be a cut-out section of the modified Vivaldi antenna in between the straight arm the tapered section. The balun may be of any suitable size and shape, so long as the balun does not disconnect the straight arm from the tapered section. The top of the tapered section may be near the same height as the top of the straight arm, and may curve outwards and downwards towards the bottom of the modified Vivaldi antenna. A body of the modified Vivaldi antenna may be below the balun, and may connect the straight arm and the tapered section.

The straight arm may be connected to a ground plane. The ground plane may be of any suitable size and shape, and may be made of any suitable material. For example, the ground plane may be the PCB of an electronic device, such as a sensor, and may be made of, for example, copper. The ground plane may include a ground plane extension, which may be made of the same material as the ground plane, and may be connected to the ground plane on an opposite side from the straight arm.

There may be a gap in between the tapered section and the ground plane. The gap may be relatively small. For example, the gap may be not more than 0.1 mm, while the ground plane may be circular with a diameter of 80 mm. The tapered section may not be connected to the ground plane directly, and may only be indirectly connected to the ground plane through the straight arm. The tapered section may have any suitable curve extending downwards towards the bottom of the modified Vivaldi antenna. The feed element may cross the gap between the ground plane and the tapered section. The feed element may be any suitable feed for an antenna, such as, for example, a coaxial cable.

The straight arm, ground plane, and ground plane extension of the modified Vivaldi antenna may be excited by low frequencies and the tapered section and gap may be excited by high frequencies, thus allowing for operation within two distinct frequency ranges. For example, the straight arm, ground plane, and ground plane extension may operate at frequencies around 800 to 900 MHz, while the tapered section may operate at around 1700 to 2200 MHz. The gap between the ground plane and the tapered section may act as a radiator for the higher frequencies, as current in the feed element may induce a voltage in the gap. The modified Vivaldi antenna may be used for electronic communications, including transmitting and receiving on any two separate frequency bands.

The modified Vivaldi antenna may be fed by any suitable amplifier, running off any suitable power source, from a trace connected to the feed element. The power source may be, for example, a battery.

The modified Vivaldi antenna may be attached to any suitable electronic device. For example, the proximity coupled multi-band antenna may be attached to the plastic body of a battery powered electronic device that may be for use in, for example, a smart home environment.

FIG. 1 shows an example perspective view of a modified Vivaldi antenna with dipole excitation mode according to an implementation of the disclosed subject matter. A device 100, which may any suitable electronic device, may include a modified Vivaldi antenna 110. The device 100 may be, for example, any suitable computing device, such as laptop, smartphone, tablet, or other computing device, or any component thereof, or any suitable electronic device, such as, for example, an electronic device used in home automation or a sensor for a smart home environment, such as described with respect to FIG. 8. The modified Vivaldi antenna 110 may be arranged on a plastic wall 117 of the device 100. The modified Vivaldi antenna 110 may include a straight arm 111, a balun 112, and a tapered section 113. The modified Vivaldi antenna 110 may be arranged in the device 100 so that there is a gap 115 between the tapered section 113 and a ground plane 116. The modified Vivaldi antenna 110 may be made of any suitable material, such as, for example, copper.

The straight arm 111 of the modified Vivaldi antenna 110 may be connected to the ground plane 116, which may be, for example, a PCB of the device 100. The ground plane 116 may be made of any suitable material, such as, for example, copper, and may act as a radiator for the modified Vivaldi antenna at lower frequencies, in a dipole mode. The ground plane 116 may be any suitable size and shape, and may, for example, be a circle with a diameter between 60 mm and 100 mm. For example, the ground plane may have a diameter of 80 mm.

The balun 112 may be a cut-out area of the modified Vivaldi antenna 110 which may act as a balun for the modified Vivaldi antenna 110. The balun may form the straight arm 111, and may separate the straight arm 111 from the tapered section 113.

The feed element 114 may receive power from any suitable power source on the device 100 through the trace 118. The feed element 114 may feed power to the modified Vivaldi antenna 110, and may return signals received by the modified Vivaldi antenna 110 to the device 100. The feed element 114 may be, for example, a coaxial cable. The feed element 114 may be arranged to cross the gap 115 between tapered section 113 and the ground plane 116. Current passing through the feed element 114 may excite voltage in the gap 115, allowing the gap 115 to act as a radiator for modified Vivaldi antenna 110 for higher frequencies in a modified tapered slot mode. There may be a dielectric layer in between the feed element 114 and the modified Vivaldi antenna 110, which may prevent the feed element from coming into electrical contact with the modified Vivaldi antenna 110.

Figure 2:
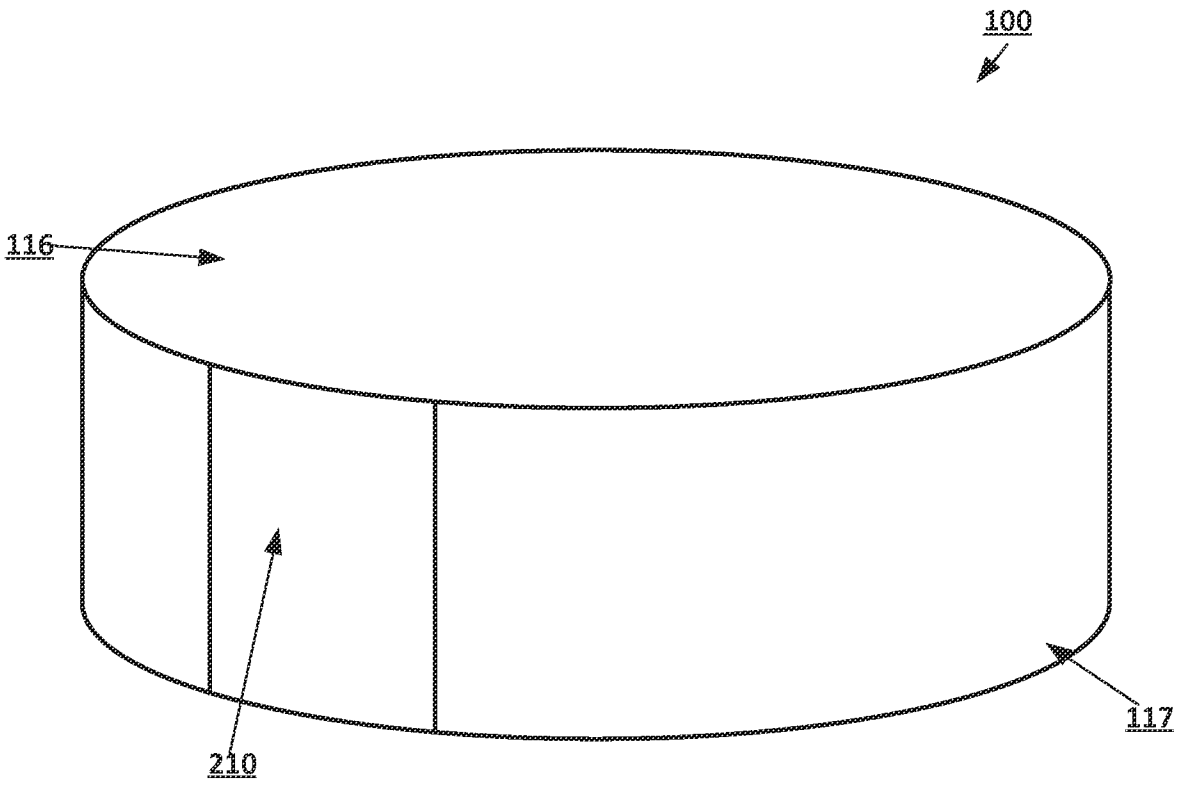
FIG. 2 shows an example perspective view of a modified Vivaldi antenna with a dipole excitation mode according to an implementation of the disclosed subject matter.

FIG. 2 shows an example perspective view of a modified Vivaldi antenna with a dipole excitation according to an implementation of the disclosed subject matter. The ground plane 116 may include a ground plane extension 210. The ground plane extension 210 may be made of the same material as the ground plane 116, and may be connected to the ground plane 116 on the opposite of the ground plane 116 from the modified Vivaldi antenna 110. The ground plane 116 and the ground plane extension 210 may be formed from the same piece of material, or may be separate pieces of material joined together. The ground plane extension 116 may assist in the operation of the modified Vivaldi antenna 110 at lower frequencies.

Figure 3A:
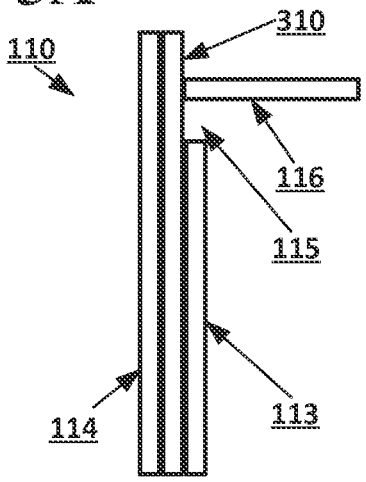
FIG. 3A shows an example side view of a modified Vivaldi antenna with a dipole excitation mode according to an implementation of the disclosed subject matter.

FIG. 3A shows an example side view of a modified Vivaldi antenna with a dipole excitation mode according to an implementation of the disclosed subject matter. A dielectric layer 310 may be in between the feed element 114 and the tapered section 113. The tapered section 310 may be arranged so that there is a gap 115 in between the tapered section 113 and the ground plane 116. The feed element 114 may cross the gap 115 between the tapered section 113 and the ground plane 116. The ground plane 116 may be oriented perpendicular to the tapered section 113 of the modified Vivaldi antenna 110. The gap 115 may be between an edge of the ground plane 116 and the modified Vivaldi antenna 110, or may be between the edge of the tapered section 113 and the ground plane 116.

Figure 3B:
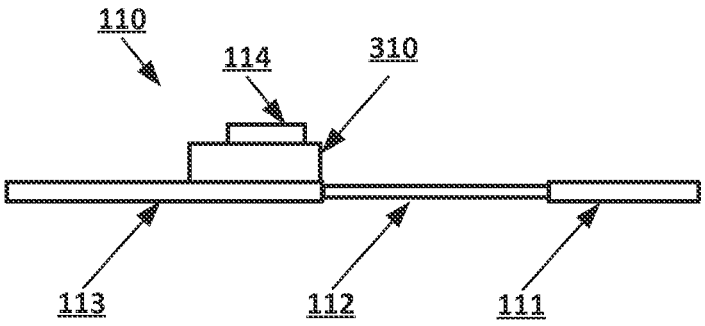
FIG. 3B shows an example cross-sectional view of a modified Vivaldi antenna with a dipole excitation mode according to an implementation of the disclosed subject matter.

FIG. 3B shows an example cross-sectional view of a modified Vivaldi antenna with a dipole excitation mode according to an implementation of the disclosed subject matter. The balun 112 may be between the straight arm 111 and the tapered section 113. A body section of the modified Vivaldi antenna 110 may be visible at the bottom end of the balun 112, connecting the straight arm 111 to the tapered section 113.

Figure 4B:
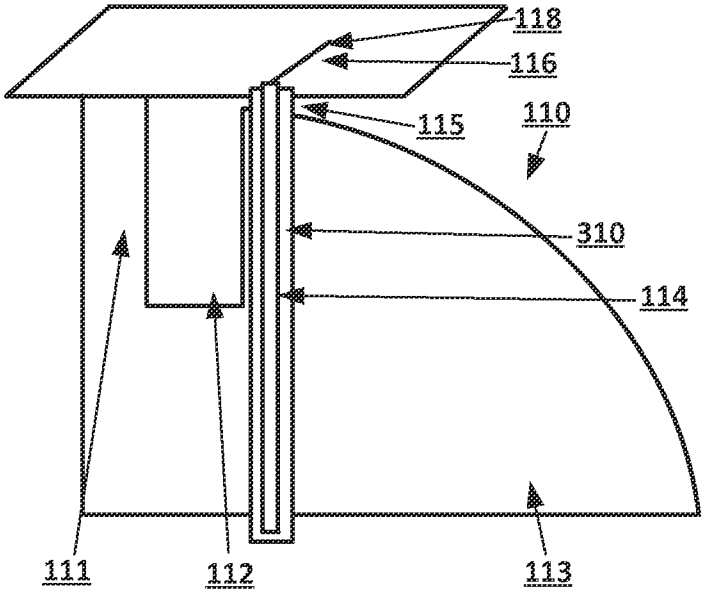
FIG. 4B shows an example of a front view of a modified Vivaldi antenna with a dipole excitation mode according to an implementation of the disclosed subject matter
Figure 4A:
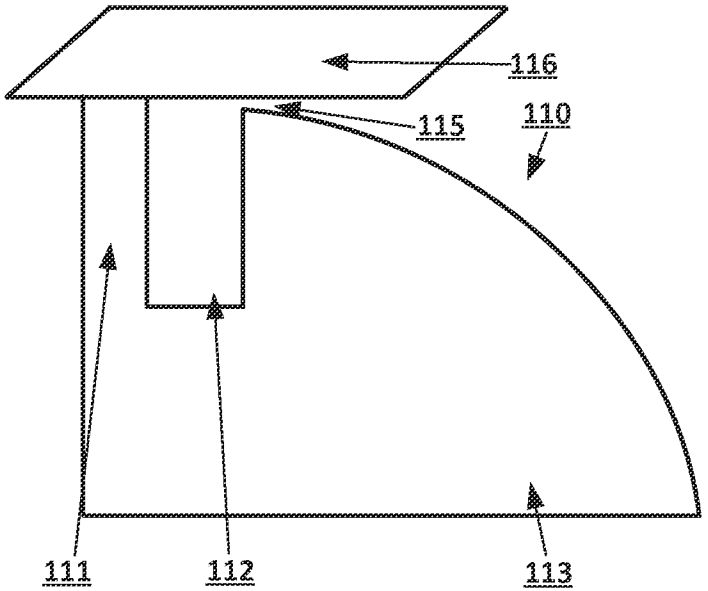
FIG. 4A shows an example of a front view of a modified Vivaldi antenna with a dipole excitation mode according to an implementation of the disclosed subject matter.

FIG. 4A shows an example of a front view of a modified Vivaldi antenna with dipole excitation mode according to an implementation of the disclosed subject matter. The modified Vivaldi antenna 110 may include the straight arm 111 and the tapered section 113 separated by the balun 112. A body section of the modified Vivaldi antenna 110 below the balun 112 may connect the straight arm 111 to the tapered section 113. The straight arm 111 may be connected to the ground plane 116. There may be a gap 115 between the tapered section 113 and the ground plane 116.

FIG. 4B shows an example of a front view of a modified Vivaldi antenna with dipole excitation mode according to an implementation of the disclosed subject matter. A feed element 114 may cross the gap 115 between the ground plane 116 and the tapered section 113. The feed element may extend any suitable distance down the modified Vivaldi antenna 113 from its origin above the gap 115. The dielectric layer 310 may be shaped to cover, and extend beyond, the surface area covered by the feed element 114. The dielectric layer 310 may also cover the gap 115. The trace 118 may connect to the feed element 114 at any suitable point on the feed element 114, such as, for example, above where the feed element 114 crosses the gap 115 between the ground 116 and the tapered section 113. The trace 118 may be connected to any suitable power source in the device 100.

Figure 5:
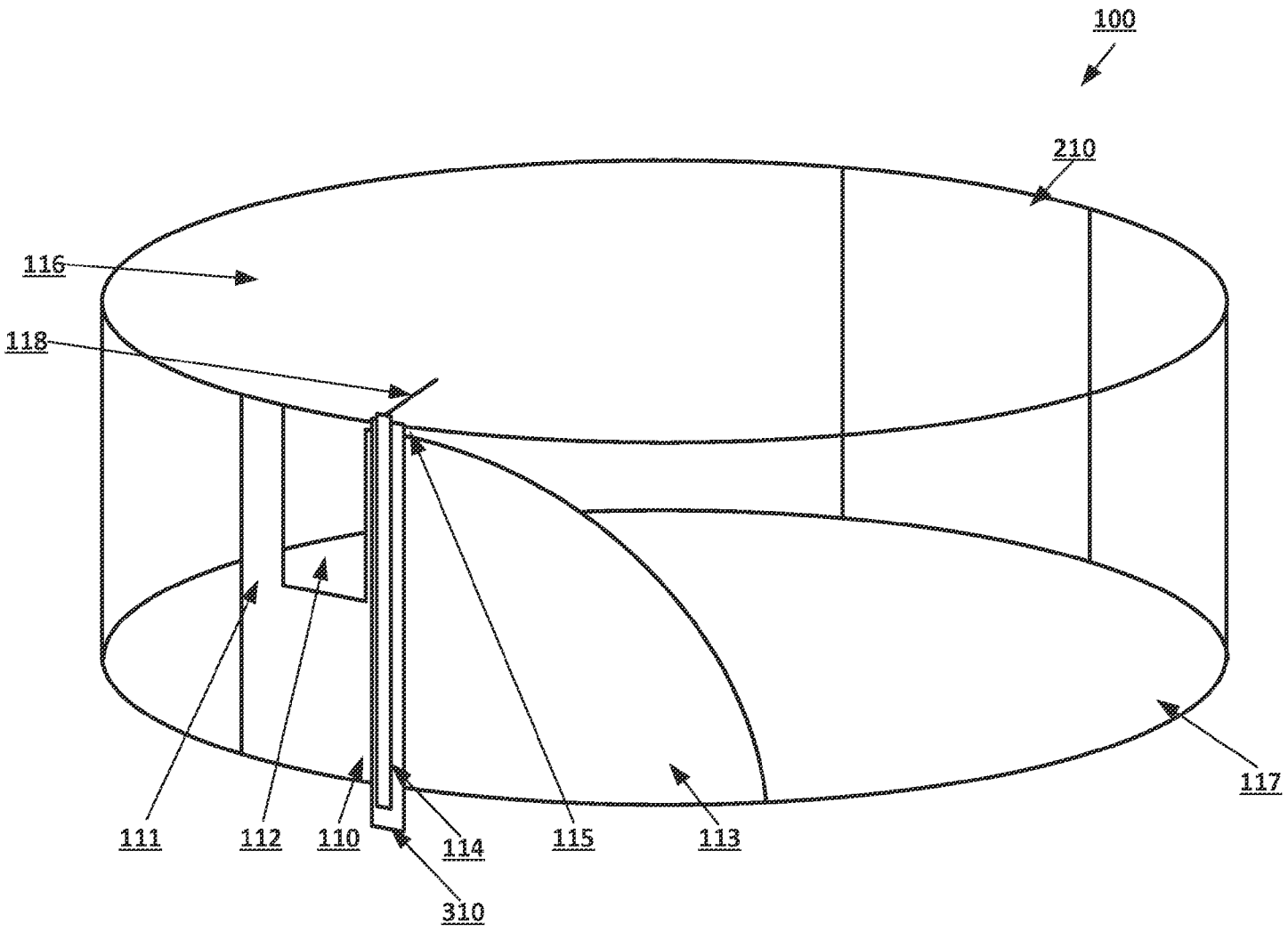
FIG. 5 shows an example perspective view of a modified Vivaldi antenna with a dipole excitation mode according to an implementation of the disclosed subject matter.

FIG. 5 shows an example perspective view of a modified Vivaldi antenna with dipole excitation mode according to an implementation of the disclosed subject matter. The ground plane extension 210 may be attached away from the modified Vivaldi antenna 110 on the device 100, for example, on the oppose side of the ground plane 116. For example, if the plastic wall 117 is a cylinder, the ground plane extension 210 may be diametrically opposite the connection between the straight arm 111 and the ground plane 116.

Figure 6:
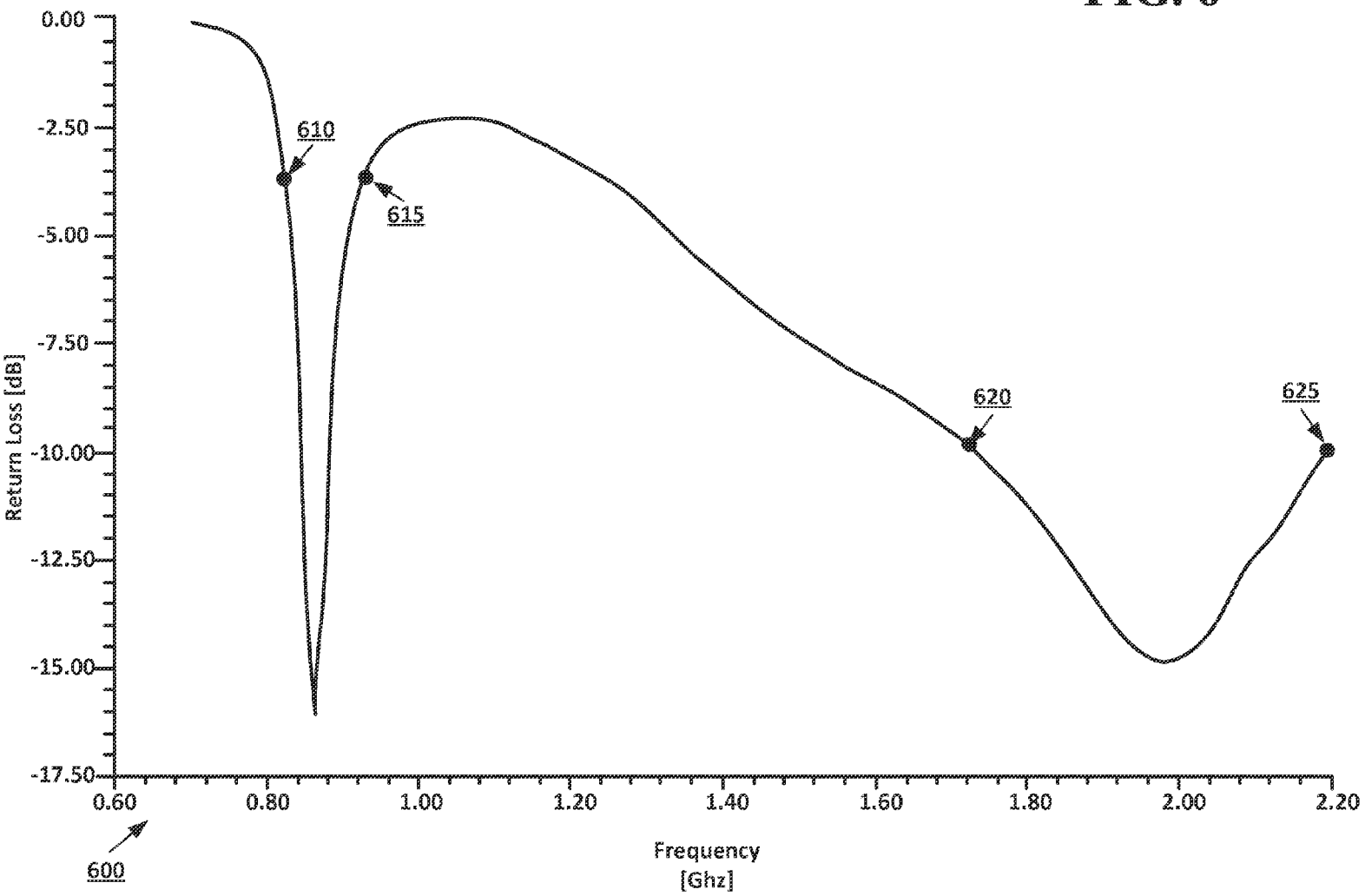
FIG. 6 shows an example of a return loss graph for a modified Vivaldi antenna with a dipole excitation mode according to an implementation of the disclosed subject matter.

FIG. 6 shows an example of a return loss graph for a modified Vivaldi antenna with a dipole excitation mode according to an implementation of the disclosed subject matter. The return loss graph 600 may plot the return loss of the modified Vivaldi antenna 110 in decibels against the frequencies, in GHz, at which the modified Vivaldi antenna 110 may operate. The dipole mode of the modified Vivaldi antenna 110 may operate best between the frequencies of 800 and 900 MHz, as shown by the plot of the return loss graph 600 between point 610, at 800 MHz, and point 615, at 900 Mhz. The tapered slot mode of the modified Vivaldi antenna 110 may operate best between the frequencies of 1700 MHz and 2200 MHz, as shown by the plot of the return loss graph 600 between point 620, at 1700 MHz, and point 625, at 2200 MHz. The return loss of the modified Vivaldi antenna 110 may be very low over these ranges of frequencies, as compared to the return loss at frequencies outside of these ranges.

Figure 7:
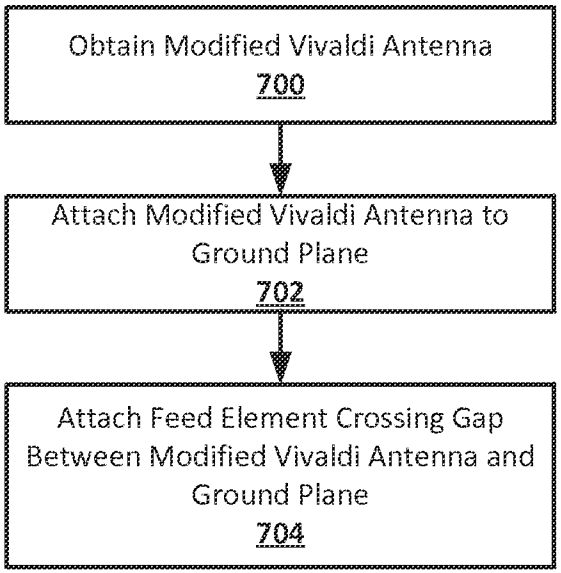
FIG. 7 shows an example of a process for assembling a modified Vivaldi antenna with a dipole excitation mode according to an implementation of the disclosed subject matter.

FIG. 7 shows an example of a process for assembling a modified Vivaldi antenna with dipole excitation mode according to an implementation of the disclosed subject matter. At 700, a modified Vivaldi antenna may be obtained. For example, the modified Vivaldi antenna 110, with straight arm 111, balun 112, and tapered section 113 may be obtained.

At 702, the modified Vivaldi antenna may be attached to a ground plane. For example, the straight arm 111 of the modified Vivaldi antenna 110 may be attached to the ground plane 116. The end of the straight arm 111 may be attached to the ground plane 116, establishing a connection between the modified Vivaldi antenna 110, the ground plane 116, and the ground plane extension 210. The attachment may leave the gap 115 in between the ground plane 116 and the tapered section 113.

At 704, a feed element may be attached across the gap between the modified Vivaldi antenna and the ground plane. For example, the feed element 114 may be attached across the gap 115 between the ground plane 116 and the tapered section 113. The trace 118 may be attached to the feed element 114 above the gap 115, before the feed element 114 crosses to the tapered section 113. The feed element 114 may extend any suitable distance down the modified Vivaldi antenna 110. The dielectric layer 310 may be placed underneath the feed element 114, separating the feed element 114 from the surface of the modified Vivaldi antenna 110. Current through the feed element 114 may excite the gap 115, allowing the gap 115 to act as a radiator.

Embodiments disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. In some cases, a sensor may operate as multiple sensor types sequentially or concurrently, such as where a temperature sensor is used to detect a change in temperature, as well as the presence of a person or animal.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

A sensor may include hardware in addition to the specific physical sensor that obtains information about the environment. FIG. 7 shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like, may allow for communication by the sensor 60 with other devices. The communication interface 63 may include or be in signal contact with a modified Vivaldi antenna as disclosed herein, for example to allow for communication on multiple separate frequencies. A user interface (UI) 62 may provide information and/or receive input from a user of the sensor. The UI 62 may include, for example, a speaker to output an audible alarm when an event is detected by the sensor 60. Alternatively, or in addition, the UI 62 may include a light to be activated when an event is detected by the sensor 60. The user interface may be relatively minimal, such as a limited-output display, or it may be a full-featured interface such as a touchscreen. Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Sensors as disclosed herein may operate within a communication network, such as a conventional wireless network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 8:
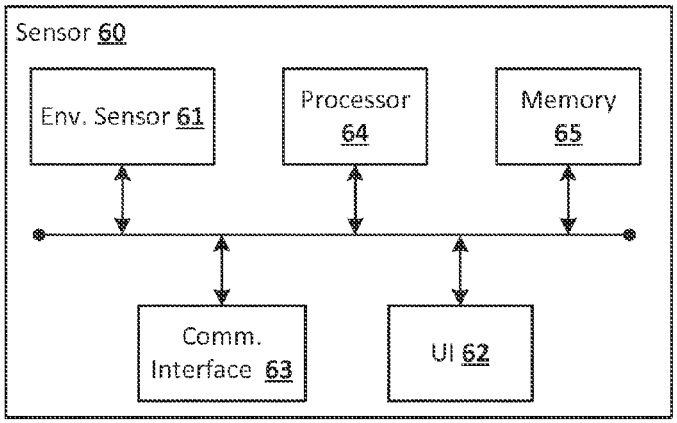
FIG. 8 shows a computing device according to an embodiment of the disclosed subject matter.

FIG. 8 shows an example of a sensor network as disclosed herein, which may be implemented over any suitable wired and/or wireless communication networks. One or more sensors 71, 72 may communicate via a local network 70, such as a Wi-Fi or other suitable network, with each other and/or with a controller 73. The controller may be a general- or special-purpose computer. The controller may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors may communicate directly with a remote system 74. The remote system 74 may, for example, aggregate data from multiple locations, provide instruction, software updates, and/or aggregated data to a controller 73 and/or sensors 71, 72. As previously described, a sensor or any other component within a sensor network may include or use a modified Vivaldi antenna when communicating with one or more other devices in the sensor network.

Figure 9:
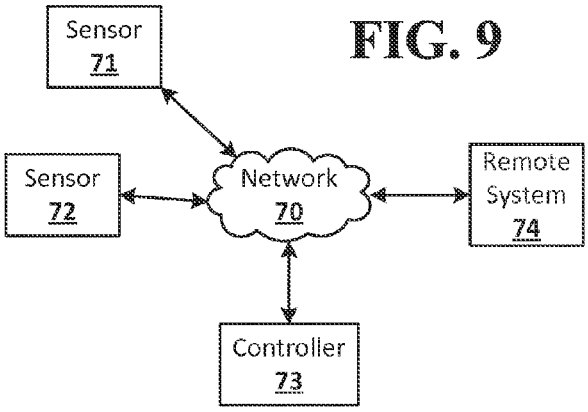
FIG. 9 shows a system according to an embodiment of the disclosed subject matter.

The sensor network shown in FIG. 9 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 9 may include a plurality of devices, including intelligent, multi-sensing, network-connected devices that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 9.

According to embodiments of the disclosed subject matter, the smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 9, and the controller 73 may control the HVAC system (not shown) of the structure.

A smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 9, and the controller 73 may control an alarm system to provide a visual and/or audible alarm to the user of the smart-home environment.

A smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 9 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be the sensors 71, 72 shown in FIG. 9. The smart wall switches may detect ambient lighting conditions, and control a power and/or dim state of one or more lights. For example, the sensors 71, 72, may detect the ambient lighting conditions, and the controller 73 may control the power to one or more lights (not shown) in the smart-home environment. The smart wall switches may also control a power state or speed of a fan, such as a ceiling fan. For example, sensors 72, 72 may detect the power and/or speed of a fan, and the controller 73 may adjusting the power and/or speed of the fan, accordingly. The smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, the smart-home environment may include one or more intelligent, multi-sensing, network-connected entry detectors (e.g., "smart entry detectors"). The sensors 71, 72 shown in FIG. 9 may be the smart entry detectors. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed.

The smart-home environment of the sensor network shown in FIG. 9 can include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of the smart-home environment (e.g., as illustrated as sensors 71, 72 of FIG. 9 can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment "learns" who is a user (e.g., an authorized user) and permits the electronic devices associated with those individuals to control the network-connected smart devices of the smart-home environment (e.g., devices communicatively coupled to the network 70). Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

The smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event, any of the network-connected smart devices, such as smart wall plugs located outdoors, detect movement at night time, the controller 73 and/or remote system 74 can activate the outdoor lighting system and/or other lights in the smart-home environment.

Figure 10:
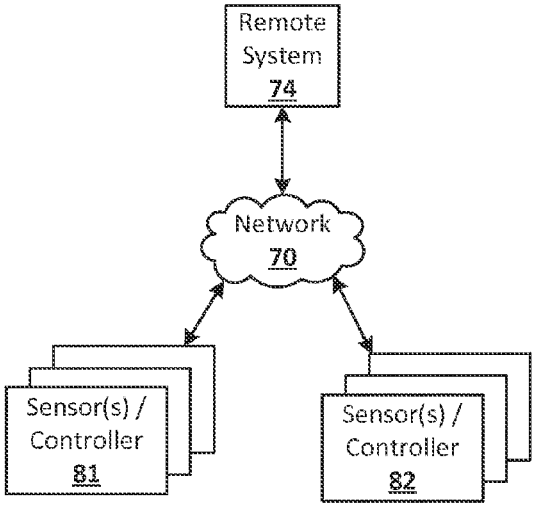
FIG. 10 shows a system according to an embodiment of the disclosed subject matter.

In some configurations, a remote system 74 may aggregate data from multiple locations, such as multiple buildings, multi-resident buildings, individual residences within a neighborhood, multiple neighborhoods, and the like. FIG. 10 shows a system according to an embodiment of the disclosed subject matter. In general, multiple sensor/controller systems 81, 82 as previously described with respect to FIG. 9 may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Figure 11:
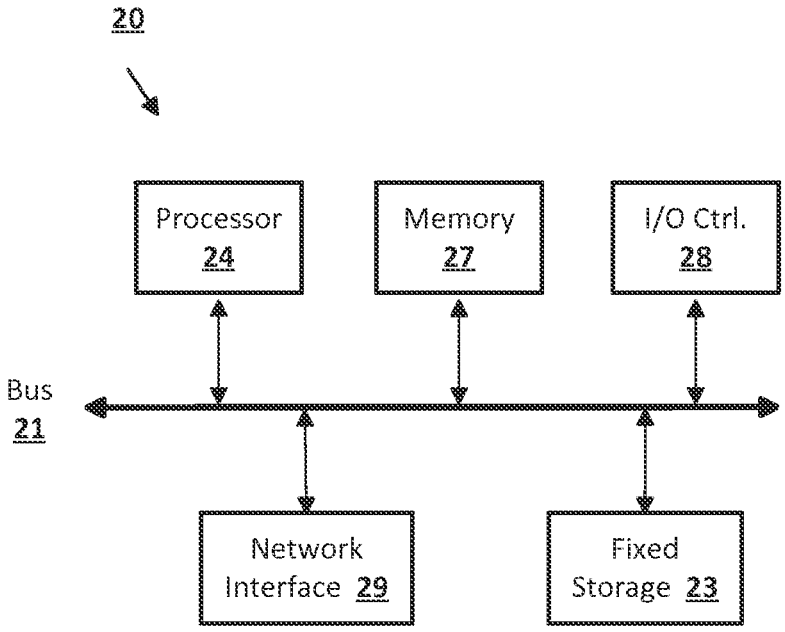
FIG. 11 shows a computer according to an embodiment of the disclosed subject matter.

Embodiments of the presently disclosed subject matter may be implemented in and used with a variety of computing devices. FIG. 11 is an example computing device 20 suitable for implementing embodiments of the presently disclosed subject matter. For example, the device 20 may be used to implement a controller, a device including sensors as disclosed herein, or the like. Alternatively or in addition, the device 20 may be, for example, a desktop or laptop computer, or a mobile computing device such as a smart phone, tablet, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen, a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide such connection using any suitable technique and protocol as will be readily understood by one of skill in the art, including digital cellular telephone. WiFi, Bluetooth®, near-field, and the like. For example, the network interface 29 may allow the device to communicate with other computers via one or more local, wide-area, or other communication networks, as described in further detail herein.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. An antenna apparatus comprising:

a ground plane;

a modified Vivaldi antenna comprising:

a straight arm comprising a first end and a second end, the first end being attached to the ground plane, a tapered section, and a balun disposed at least partially between the straight arm and the tapered section wherein the modified Vivaldi antenna is disposed such that there is a gap between the tapered section and the ground plane; and a feed element disposed such that the feed element crosses the gap between the tapered section of the modified Vivaldi antenna and the ground plane, wherein a ground plane extension attached to the ground plane, the ground plane extension disposed on the wall opposite the modified Vivaldi antenna.

2. The apparatus of claim 1, wherein the ground plane is perpendicular to the modified Vivaldi antenna.

3. The apparatus of claim 1, wherein the gap is disposed between an edge of the ground plane and the modified Vivaldi antenna, or between an edge of the modified Vivaldi antenna and the ground plane.

4. The apparatus of claim 1, wherein the modified Vivaldi antenna comprises copper.

5. The apparatus of claim 1, wherein the gap between the tapered section and the ground plane is at most 0.1 mm.

6. The apparatus of claim 1, further comprising a trace connecting the feed element to a power source.

7. The apparatus of claim wherein the ground plane extension attaches to the ground plane diametrically opposite where the straight arm attaches to the ground plane.

8. The apparatus of claim 1, wherein the tapered section tapers away from the ground plane towards a bottom of the modified Vivaldi antenna.

9. The apparatus of claim 1, wherein the balun is a rectangular cut-out between the straight arm and the tapered section.

10. The apparatus of claim 1, wherein a current in the feed element induces a voltage in the gap.

11. The apparatus of claim 1, wherein the gap is a radiator for high frequency operation of the modified Vivaldi antenna in a tapered slot mode.

12. The apparatus of claim 1, wherein the ground plane is a radiator for low frequency operation of the modified Vivaldi antenna in a dipole mode.

13. The apparatus of claim 1, wherein the ground plane is a printed circuit board.

14. An antenna apparatus comprising:

a modified Vivaldi antenna with a straight arm, a balun, and a tapered section;

a wall; and a ground plane, wherein the modified Vivaldi antenna is disposed on the wall such that the straight arm is connected to the ground plane and there is a gap between the tapered section and the ground plane, wherein a ground plane extension is attached to the ground plane, the ground plane extension disposed on the wall opposite the modified Vivaldi antenna.

15. The apparatus of claim 14, wherein the gap between the tapered section and the ground plane is at most 0.1 mm.

16. The apparatus of claim 14, further comprising:

a feed element disposed across the gap between the ground plane and the tapered section.

17. The apparatus of claim 14, wherein the gap is a radiator for high frequency operation of the modified Vivaldi antenna.

18. The apparatus of claim 14, wherein the ground plane is a radiator for low frequency operation of the modified Vivaldi antenna.

19. The apparatus of claim 14, wherein the modified Vivaldi antenna operates on a first frequency band with the ground plane and straight arm, and operates on a second frequency band with the gap between the tapered section and the ground plane, the first frequency band being lower than the second frequency band.

20. A method comprising:

obtaining a modified Vivaldi antenna;

attaching a straight arm of the modified Vivaldi antenna to a ground plane, leaving a gap between a tapered section of the modified Vivaldi antenna and the ground plane, wherein a ground plane extension is attached to the ground plane, the ground plane extension disposed opposite the modified Vivaldi antenna; and attaching a feed element across the gap.

* * * * *